US008570127B2

(12) United States Patent
Wang et al.

(10) Patent No.: US 8,570,127 B2
(45) Date of Patent: Oct. 29, 2013

(54) HIGH MAGNETIC FIELD SUPERCONDUCTING MAGNET SYSTEM WITH LARGE CROSSING WARM BORE

(75) Inventors: Qiuliang Wang, Beijing (CN); Xinning Hu, Beijing (CN); Yinming Dai, Beijing (CN); Baozhi Zhao, Beijing (CN); Luguang Yan, Beijing (CN); Shousen Song, Beijing (CN); Housheng Wang, Beijing (CN); Yuanzhong Lei, Beijing (CN); Hui Wang, Beijing (CN)

(73) Assignee: Institute of Electrical Engineering, Chinese Academy of Sciences, Beijing (CN)

( * ) Notice: Subject to any disclaimer, the term of this patent is extended or adjusted under 35 U.S.C. 154(b) by 0 days.

(21) Appl. No.: 13/520,511

(22) PCT Filed: Jul. 1, 2010

(86) PCT No.: PCT/CN2010/000993
§ 371 (c)(1),
(2), (4) Date: Jul. 3, 2012

(87) PCT Pub. No.: WO2011/094917

PCT Pub. Date: Aug. 11, 2011

(65) Prior Publication Data

US 2013/0033346 A1 Feb. 7, 2013

(30) Foreign Application Priority Data

Feb. 3, 2010 (CN) ..... 2010 1 0105262

(51) Int. Cl.
*H01F 6/00* (2006.01)

(52) U.S. Cl.
USPC ..... 335/216; 335/296

(58) Field of Classification Search
USPC ..... 335/216, 296–299; 505/150, 230; 324/318–320
See application file for complete search history.

(56) References Cited

U.S. PATENT DOCUMENTS 5,917,393 A * 6/1999 Kupiszewski et al. ..... 335/216
6,735,848 B1 * 5/2004 Markiewicz et al. ..... 29/599

(Continued)

FOREIGN PATENT DOCUMENTS

CN 101552077 A 10/2009
CN 101728051 A 6/2010
WO WO 2011/094917 A1 8/2011

OTHER PUBLICATIONS

International Search Report and Written Opinion for International Application No. PCT/CN2010/000993, mailed Nov. 18, 2010.

*Primary Examiner* — Bernard Rojas

(57) ABSTRACT

A high magnetic field superconducting magnet system with large crossing warm bore is disclosed, a superconducting coil thereof includes a low temperature superconducting coil and a high temperature superconducting coil. The superconducting coils are connected to a thermal shield and a flange of a low temperature container by a supporting drawbar, thus the superconducting coils as a whole are supported inside the low temperature container. A thermal switch is connected to a primary cold head and a secondary cold head of the cryocooler. The secondary cold head of the cryocooler is connected to a magnet-reinforced supporting flange at the two ends of the low temperature superconducting coil and the high temperature superconducting coil by a cold conduction strip. The superconducting magnet system has a room temperature bore in horizontal direction and a room temperature bore in vertical direction. A thermal shield outside the room temperature bore in horizontal direction is used for preventing thermal radiation by the room temperature bore in horizontal direction to the superconducting coils. A separation supporting frame separates the low temperature superconducting coil and the high temperature superconducting coil into two parts, such that a two-dimensional room temperature space can be included inside the superconducting magnet when the superconducting magnet system is formed as a whole.

9 Claims, 3 Drawing Sheets

(56) References Cited

U.S. PATENT DOCUMENTS 6,856,062 B2 * 2/2005 Heiberger et al. ..... 310/178
7,015,779 B2 * 3/2006 Markiewicz et al. ..... 335/299
8,054,077 B2 * 11/2011 Hsieh et al. ..... 324/307
8,204,563 B2 6/2012 Wang et al.

* cited by examiner

HIGH MAGNETIC FIELD SUPERCONDUCTING MAGNET SYSTEM WITH LARGE CROSSING WARM BORE

CROSS-REFERENCE TO RELATED APPLICATIONS

This application claims priority under 35 U.S.C. §371 to, and is a U.S. national phase application of, International Application No. PCT/CN2010/000993, filed Jul. 1, 2010, entitled "HIGH MAGNETIC FIELD SUPERCONDUCTING BODY SYSTEM HAVING LARGE SEPARATION GAP," which claims priority to Chinese Application No. 201010105262.6, filed Feb. 3, 2010, the disclosures of each are incorporated herein by reference in their entirety.

TECHNICAL FIELD

The present invention relates to a high magnetic field superconducting magnet system, and more specifically, to a high magnetic field superconducting magnet system with large crossing warm bore.

BACKGROUND ART

With the development of the cryogenic technology and the superconducting technology, a high magnetic field conduction-cooled superconducting magnet is convenient for system operation and has the advantage of compact size and light weight, due to its cryogenic system of a simple structure without the limitations of liquid helium or other cryogenic conditions. The critical technology of a conduction-cooled superconducting magnet system is that a cryocooler is employed to directly cool a superconducting magnet, which overcomes the conventional cooling method in which the superconducting magnet has to be cooled by using cryogenic liquid. With the development of the high temperature superconducting wire technology, Bi-based tape has a current density of $J_c=10^4$-$10^5$ A/cm$^2$ within a temperature range of 20~30K, even under a relatively high magnetic field. In such situation, the high temperature superconducting magnet that is cooled directly by a cryocooler has a relatively important meaning. The high temperature superconducting magnet operating at a temperature zone of 20K can make full use of the mature technology of a cryocooler of a temperature zone of 20K as well as the current carrying capacity of the high temperature superconductor and the high thermal conductivity and heat capacity of the superconducting tape, thus the high temperature superconducting magnet has a relatively high stability.

The high magnetic field superconducting magnet has important applications in the aspects of industry and scientific instrument. In situations such as multi-physical fields cooperatively act on a material under extreme conditions to study the physical characteristic, and neutron scattering, X-ray diffraction and synchronized radiation light sources are used to study the substance structure, a high magnetic field superconducting magnet with a certain size of crossing warm bore is needed to provide a background magnetic field for substance study. Such a superconducting magnet has an electromagnetic structure of relatively more complex as compared to that of an ordinary magnet, with a prominent feature of having a very large crossing warm bore so as to be suitable to access available magnetic field areas in lateral direction of the magnet. Thus, it has important applications in scientific instruments and other scientific study apparatus of extreme conditions, thereby providing innovative scientific study instrument and platform.

In this kind of superconducting magnet, due to a special crossing warm bore, the superconducting magnet will subject to a relatively strong electromagnetic force due to the interaction between superconducting coils under a high magnetic field. If the temperature is 4K, a method using combination of NbTi and $Nb_3Sn$ can generate a magnetic field of 18 T, and when the operating temperature is 2.2K, it can provide a central magnetic field up to 21 T. Recently, with the successful development of $Nb_3Sn$ superconducting wire having high current density, the superconducting magnet can provide a maximum magnetic field up to 22.3 T when the operating temperature reaches 1.8K.

In order to access the magnetic field zone in multi-dimensional directions, the superconducting magnet having super-large gap separates the superconducting coils along the direction of the magnetic field, thereby forming a relatively strong magnetic field area which can be accessed simultaneously in both the vertical and parallel directions of the superconducting magnet. Currently used low temperature superconducting magnet has a separation gap less than 20 mm, the system thereof is merely capable of providing a maximum magnetic field of 15~17 T. In order to obtain a superconducting magnet system with coils separated by a large crossing warm bore, which has simple process and low fabrication cost, and will become an innovative superconducting magnet that can be used in combination with special material processing, X-ray, neutron scattering, other high temperature condition, high-pressure condition and associated scientific instrument, a high magnetic field magnet structure having a crossing warm bore over 100 mm is required, so as to provide a magnetic field exceeding 10 T. This magnet enables samples or other instruments to reach the relatively strong magnetic field area from different directions, thereby forming a high magnetic field magnet system that operates stably and can be applied to scientific instruments as well as scientific apparatus used for study under extreme conditions.

SUMMARY OF THE INVENTION

The present invention aims to overcome the defect that the existing separated superconducting magnet has a crossing warm bore not large enough, and proposes a high magnetic field superconducting magnet system with large crossing warm bore. The present invention proposes a conduction-cooled superconducting magnet using NbTi and high temperature superconductor, wherein the high magnetic field area of the magnet uses the high temperature superconductor, the low magnetic field area uses the NbTi, and the superconducting magnet system operates at a temperature of 4K and provides a central magnetic field strength of 10 T. Since the superconducting magnet system adopts a manner of direct cooling by a cryocooler, it significantly improves the use efficiency of the superconducting coils and reduces the distance between coils.

The cryocooler of the superconducting magnet system with large crossing warm bore according to the present invention is fixed on a flange of a low temperature container, a primary cold head of the cryocooler cools a thermal shield of the low temperature container, while a secondary cold head of the cryocooler cools a low temperature superconducting coil and a high temperature superconducting coil. The low temperature superconducting coil and the high temperature superconducting coil are supported and fixed together by a drawbar. The low temperature superconducting coil and the high temperature superconducting coil are connected to the flange of the low temperature container by a supporting drawbar and the thermal shield, thus the low temperature superconducting coil and the high temperature superconducting coil as a whole are supported inside the low temperature container. A thermal switch is connected to the primary cold head and the secondary cold head of the cryocooler. The two ends of the low temperature superconducting coil and the high temperature superconducting coil are fixed by a magnet-reinforced supporting flange. The magnet-reinforced supporting flange is connected to the secondary cold head of the cryocooler by a cold conduction strip to conduct the cold energy from the cryocooler to the low temperature superconducting coil and the high temperature superconducting coil. The low temperature superconducting coil and the high temperature superconducting coil have current introduced thereto by a room temperature current lead and a high temperature superconducting current lead, respectively. The superconducting magnet conducts quench protection by a quench protection diode. The superconducting magnet system of the present invention has a room temperature bore in horizontal direction and a room temperature bore in vertical direction. A thermal shield outside the room temperature bore in horizontal direction is used for preventing thermal radiation by the room temperature bore in horizontal direction to the low temperature superconducting coil and the high temperature superconducting coil. A separation supporting frame separates the low temperature superconducting coil and the high temperature superconducting coil into two parts, such that a two-dimensional room temperature space can be included inside the superconducting magnet when the superconducting magnet is formed as a whole.

The superconducting magnet of the present invention consists of the low temperature superconducting coil and the high temperature superconducting coil, and generates a magnetic field with a range of 8~10 T and can employ a structure in which the high temperature superconducting inside coil is internally placed and an NbTi superconducting coil is externally placed. If the central magnetic field is above 10 T, the present invention will employ a combined structure of high temperature superconductor, $Nb_3Sn$ and NbTi superconducting coils, wherein the three kinds of superconducting coils are powered separately.

The superconducting magnet coil of the present invention is separated into two parts by a gap larger than 100 mm. The high temperature superconducting coil is located inside the low temperature superconducting coil. A crossing room temperature bore having a crossing seal structure is used to form a two-dimensional room temperature space, such that inside the superconducting magnet, the high magnetic field area inside the superconducting magnet can be directly accessed in two-dimensional directions through the crossing room temperature bore.

According to the present invention, the crossing room temperature bore is placed inside the low temperature container in parallel magnetic field and vertical magnetic field directions. In order to save the space of the vertical separation gap, there is a hole of a circular structure in the middle of a separation supporting frame such that the room temperature bore can directly pass through. After the installation of the crossing room temperature bore, the separated coils are connected. The low temperature superconducting coil and the high temperature superconducting coil are separated into two parts by the separation supporting frame in horizontal direction, to form a superconducting coil structure having a crossing bore. A spacer, stainless steel supporting block for support between coils and aluminum alloy supporting block constitute the separation supporting frame. The cross room temperature bore passes through the centers of the stainless steel supporting block and the aluminum alloy supporting block. The two parts of separated coils consisting of the low temperature superconducting coil and the high temperature superconducting coil are respectively mounted to the two ends of the spacer. The separation supporting frame employs a structure in which the stainless steel supporting block and the aluminum alloy supporting block are mutually nested with the two ends fixed by the spacer. The stainless steel supporting block and the aluminum alloy supporting block are used for supporting the superconducting coils, meanwhile the aluminum alloy supporting block conducts thermal transfer between the two parts of superconducting coils.

The superconducting magnet of the present invention as a whole is directly placed inside the low temperature container, and power is supplied to the superconducting coil by connections of the high temperature superconducting current lead and the conventional current lead. A temperature control system is used for detecting operation temperature state of the superconducting coil. One or more cryocoolers are connected to the superconducting coil, for directly conducting the cold energy from the cryocooler to the superconducting coil, thereby reaching required low temperature.

The superconducting coil of the present invention adopts a manner in which power is supplied by different power sources, and the superconducting coil of each superconducting material is connected to one power source. The superconducting coil adopts a shunted protection manner. A protection diode for the low temperature superconducting coil is constituted by two parallel diodes with opposite polarities, and a plurality of protection diodes for the low temperature superconducting coil are connected in series. The number of the protection diodes for the low temperature superconducting coil depends on the voltage resistance capability of the superconducting coil. In order to decrease the highest temperature generated by the high energy density superconducting coil in the event of quench and release the energy of the superconducting coil evenly inside the magnet, a heater is mounted in the axial direction of the inner surface of the high and low temperature superconducting coils. When a local quench of the superconducting coil occurs, the energy is directly transferred to the heater, thus triggering a quench of the entire superconducting coil. The stored energy can be quickly and evenly released so as to suppress the temperature increase of the superconducting coil to the greatest extent.

The present invention adopts a technology in which a cryocooler is directly used for cooling, which can reduce the distance between coils and improve the use efficiency of the coils. In addition, since the magnet structure and the low temperature container structure are simple, the system can operate stably. Meanwhile, the use of this innovative technology can considerably reduce system operation cost and make system operation, manipulation and installation more convenient and reliable.

BRIEF DESCRIPTION OF THE ATTACHED DRAWINGS

FIG. 1 is a structural diagram showing the entire superconducting and low temperature system, in which: 1 denotes a cryocooler, 2 denotes a flange of a low temperature container, 3 denotes a thermal shield, 4 denotes a high temperature superconducting current lead, 5 denotes a cold conduction strip, 6 denotes a quench protection diode, 7 denotes a thermal switch, 8 denotes a supporting drawbar, 9 denotes a separation supporting frame, 10 denotes a magnet-reinforced supporting flange, 11 denotes a thermal shield outside a room temperature bore in horizontal direction, 12 denotes the room temperature bore in horizontal direction, 13 denotes a room temperature current lead, 14 denotes a drawbar, 15 denotes a room temperature bore in vertical direction, 16 denotes a low temperature superconducting magnet, 17 denotes a high temperature superconducting magnet, 18 denotes a crossing room temperature bore;

Figure 5:
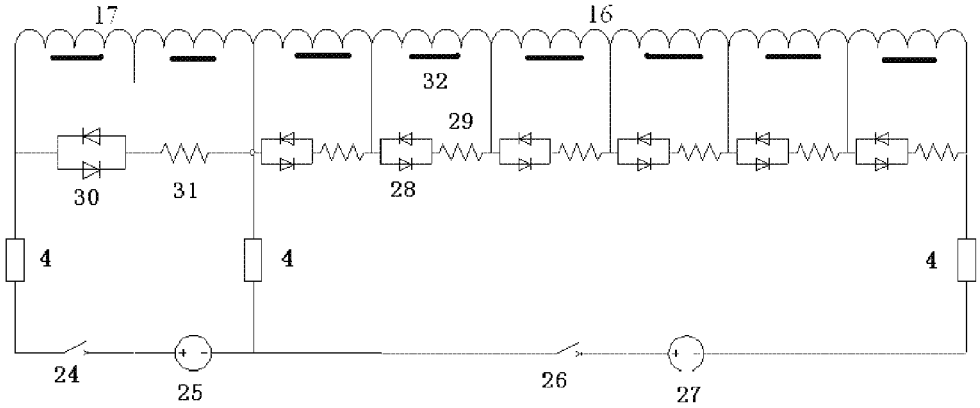

FIG. 5 shows a quench protection circuit for the superconducting coil, in which: 24 denotes a power supply circuit switch for the high temperature superconducting coil, 25 denotes a power source for the high temperature superconducting coil, 26 denotes a power supply circuit switch for the low temperature superconducting coil, 27 denotes a power source for the low temperature superconducting coil, 28 denotes a protection diode for the low temperature superconducting coil, 29 denotes an energy dump resistor for the low temperature superconducting coil, 30 denotes a protection diode for the high temperature superconducting coil, 31 denotes an energy dump resistor for the high temperature superconducting coil, and 32 denotes a quench trigger heater.

DETAILED DESCRIPTION OF THE PREFERRED MODES

The present invention is further explained below in conjunction with the attached drawings and particular embodiments.

Figure 1:
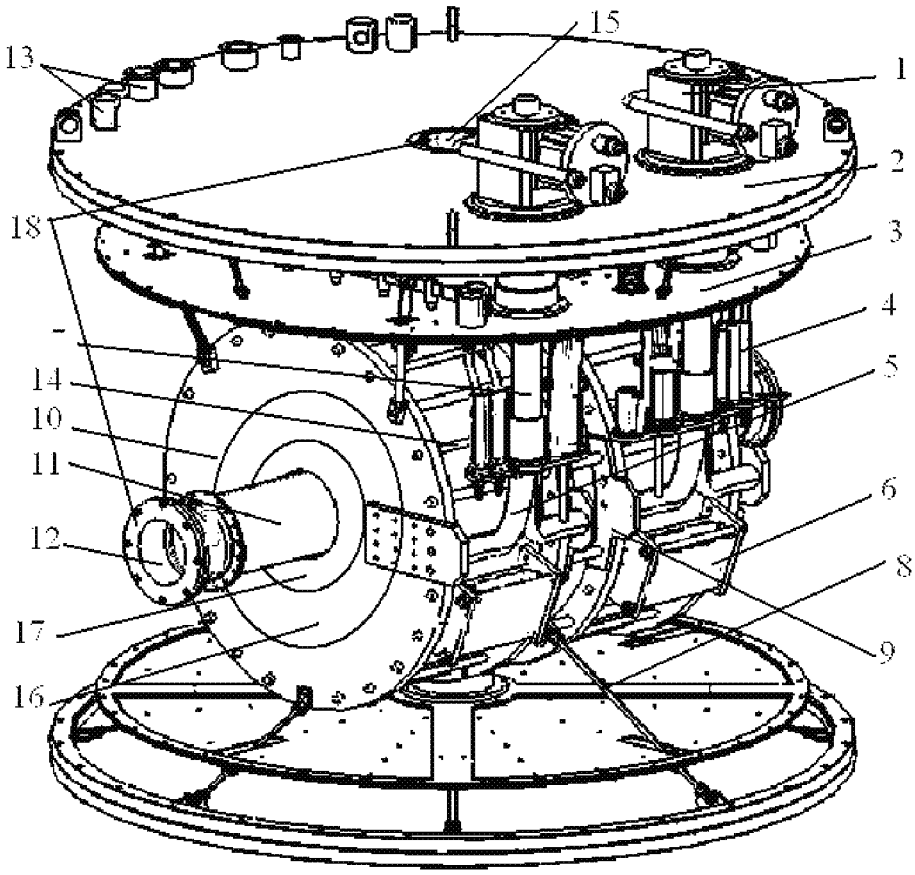

As shown in FIG. 1, a cryocooler 1 is fixed on a flange of a low temperature container 2, a primary cold head of the cryocooler 1 cools a thermal shield 3 of the low temperature container, while a secondary cold head of the cryocooler 1 cools a low temperature superconducting coil 16 and a high temperature superconducting coil 17. The low temperature superconducting coil 16 and the high temperature superconducting coil 17 are supported and fixed together by a drawbar 14. The low temperature superconducting coil 16 and the high temperature superconducting coil 17 are connected to the flange of the low temperature container 2 by a supporting drawbar 8 and the thermal shield 3, thus the low temperature superconducting coil 16 and the high temperature superconducting coil 17 as a whole are supported inside the low temperature container. A thermal switch 7 is connected to the primary cold head and the secondary cold head of the cryocooler 1. The two ends of the low temperature superconducting coil 16 and the high temperature superconducting coil 17 are fixed by a magnet-reinforced supporting flange 10. The magnet-reinforced supporting flange 10 is connected to the secondary cold head of the cryocooler 1 by a cold conduction strip 5, thus conducting the cold energy from the cryocooler 1 to the low temperature superconducting coil 16 and the high temperature superconducting coil 17. The low temperature superconducting coil 16 and the high temperature superconducting coil 17 have current introduced thereto by a room temperature current lead 13 and a high temperature superconducting current lead 4. The superconducting magnet system conducts quench protection by a quench protection diode 6. The superconducting magnet system has a room temperature bore in horizontal direction 12 and a room temperature bore in vertical direction 15. At the periphery of the room temperature bore in horizontal direction 12, there has a thermal shield 11 arranged coaxially outside the room temperature bore in horizontal direction and used for preventing the thermal radiation by the room temperature bore in horizontal direction 12 to the low temperature superconducting coil 16 and the high temperature superconducting coil 17. A separation supporting frame 9 separates the low temperature superconducting coil 16 and the high temperature superconducting coil 17 into two parts, such that a two-dimensional room temperature space can be included inside the superconducting magnet when the superconducting magnet is formed as a whole.

Figure 2:
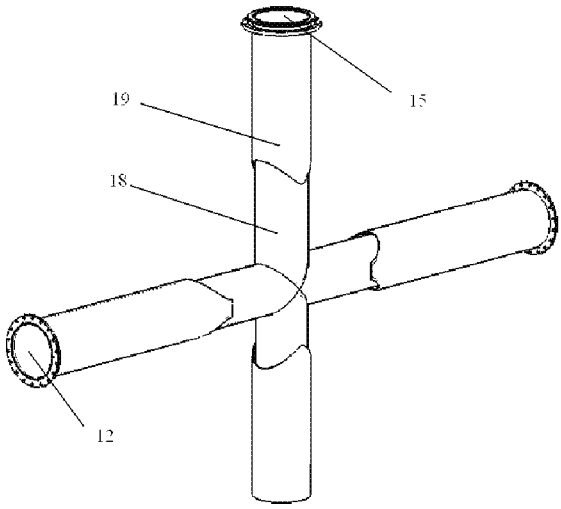
FIG. 2 is a structural diagram for room temperature accessible space of the superconducting magnet, in which: 19 denotes a thermal shield for the crossing room temperature bore.

FIG. 2 shows a structure of a crossing room temperature bore. A stainless steel crossing room temperature bore 18 includes the room temperature bore in horizontal direction 12 and the room temperature bore in vertical direction 15 therein, for providing access to a strong magnetic field space in both horizontal and vertical directions. In order to prevent thermal radiation between a low temperature of 4K and a room temperature, a thermal shield 19 is coaxially arranged at the periphery of the crossing room temperature bore 18. The thermal shield 19 is made of copper and its outer surface is wrapped with aluminum foil, which can considerably reduce thermal radiation.

Figure 3:
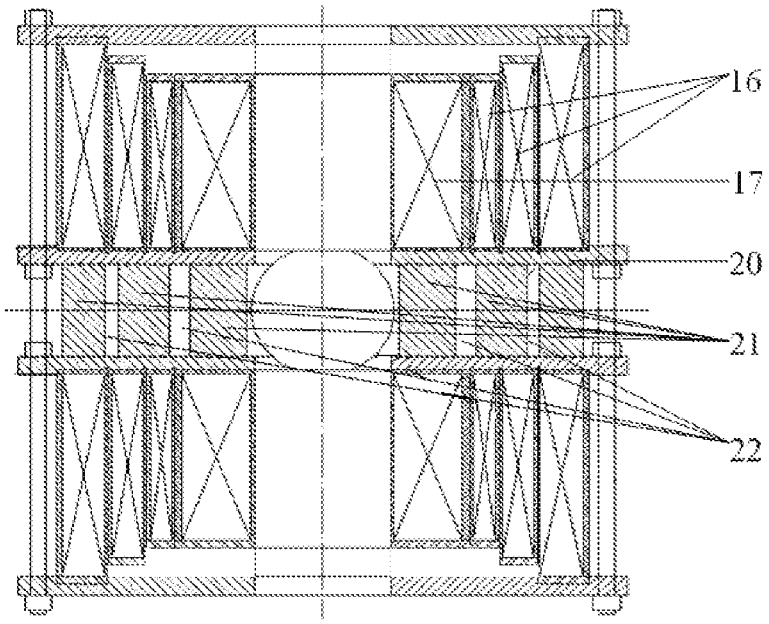
FIG. 3 shows a structure of the superconducting coil, in which: 20 denotes a spacer, 21 denotes a stainless steel supporting block, and 22 denotes an aluminum alloy supporting block.

As shown in FIG. 3, the low temperature superconducting coil 16 and the high temperature superconducting coil 17 are separated into two parts by the separation supporting frame 9 in a horizontal direction, whereby forming a superconducting coil structure having a crossing bore. Spacer 20, stainless steel supporting block 21 for support between coils, and aluminum alloy supporting block 22 constitute the separation supporting frame 9. The separation supporting frame 9 employs a structure in which the stainless steel supporting block 21 and the aluminum alloy supporting block 22 are mutually nested and the two ends thereof are fixed by the spacer 20. The crossing room temperature bore 18 passes through the centers of the stainless steel supporting block 21 and the aluminum supporting block 22. The two parts of separated coils consisting of the low temperature superconducting coil 16 and the high temperature superconducting coil 17 are respectively mounted to the two ends of the spacer 20. The stainless steel supporting block 21 and the aluminum alloy supporting block 22 are used for supporting the superconducting coils, meanwhile the aluminum alloy supporting block 22 also conducts thermal transfer between the two parts of superconducting coils.

Figure 4:
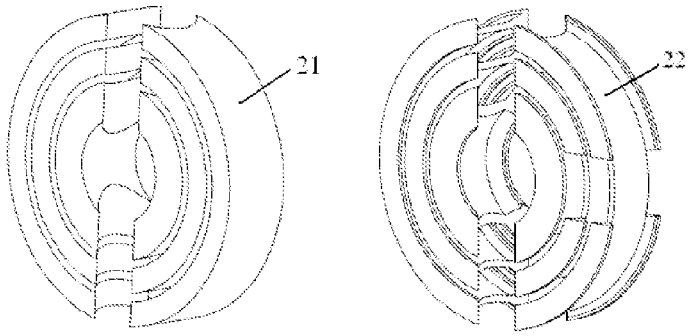
FIG. 4 is a structural diagram showing the stainless steel supporting block and the aluminum alloy supporting block.

As shown in FIG. 4, the supporting block for supporting the separated coils can employ the stainless steel supporting block 21 and the aluminum alloy supporting block 22.

As shown in FIG. 5, in a quench protection circuit of the superconducting magnet system, the superconducting coil adopts a manner in which power is supplied by different power sources. The low temperature superconducting coil 16 is powered by a power source 27 for the low temperature superconducting coil, while the high temperature superconducting coil 17 is powered by a power source 25 for the high temperature superconducting coil. The high temperature superconducting coil 17 is connected in series with a protection circuit for the high temperature superconducting coil. The high temperature superconducting coil 17 is powered by a power source system consisting of the high temperature superconducting current lead 4, a power supply circuit switch 24 for the high temperature superconducting coil and a power source 25 for the high temperature superconducting coil. The quench protection circuit for the high temperature superconducting coil 17 is constituted by a protection diode 30 for the high temperature superconducting coil, a energy dump resistor 31 for the high temperature superconducting coil and a quench trigger heater 32 connected in series, wherein the protection diode 30 for the high temperature superconducting coil consists of two parallel diodes with opposite polarities. Likewise, the low temperature superconducting coil 16 is powered by the power source 27 for the low temperature superconducting coil via a power supply circuit switch 26 for the low temperature superconducting coil. The low temperature superconducting coil 16 is divided into six subdivisions, each subdivision being connected in series with a protection diode for the low temperature superconducting coil and an energy dump resistor for the low temperature superconducting coil respectively, to form a single loop of the quench protection circuit. The quench protection circuit for the low temperature superconducting coil is formed by six single loops connected in series, wherein one single loop of the quench protection circuit for the low temperature superconducting coil 16 is constituted by a protection diode 28 for the low temperature superconducting coil, a energy dump resistor 29 for the low temperature superconducting coil and a quench trigger heater 32 connected in series. The protection diode 28 for the low temperature superconducting coil is constituted by two parallel diodes with opposite polarities, and a plurality of protection diodes for the low temperature superconducting coil are connected in series. The number of the protection diodes for the low temperature superconducting coil depends on the voltage resistance capability of the superconducting coil. In order to decrease the highest temperature generated by the high energy density superconducting coil in the event of quench and evenly release the energy of the superconducting coil inside the magnet, a heater is mounted in an axial direction of the inner surface of the high and low temperature superconducting coils. When a local quench of the superconducting coil occurs, the energy is directly transferred to the heater, thus triggering a quench of the entire superconducting coil. The stored energy can be quickly and evenly released so as to suppress the temperature increase of the superconducting coil to the greatest extent.

The invention claimed is:

1. A high magnetic field superconducting magnet system with large crossing warm bore, comprising:

a cryocooler, a low temperature container, a superconducting coil, a thermal switch, a cold conduction strip, and a current lead, wherein said cryocooler is fixed on a flange of the low temperature container, a primary cold head of the cryocooler cools a thermal shield of the low temperature container and a secondary cold head of the cryocooler cools a low temperature superconducting coil and a high temperature superconducting coil, characterized in that, said superconducting magnet system has a room temperature bore in horizontal direction and a room temperature bore in vertical direction; a thermal shield outside the room temperature bore in horizontal direction is coaxially arranged at the periphery of the room temperature bore in horizontal direction and is used for preventing thermal radiation by the room temperature bore in horizontal direction to the low temperature superconducting coil and the high temperature superconducting coil; a separation supporting frame separates the low temperature superconducting coil and the high temperature superconducting coil into two parts, such that a two-dimensional room temperature space can be included inside the superconducting magnet system when the superconducting magnet system is formed as a whole.

2. The high magnetic field superconducting magnet system with large crossing warm bore according to claim 1, characterized in that, said separation supporting frame is constituted by spacer, stainless steel supporting block for support between coils, and aluminum alloy supporting block, the stainless steel supporting block and the aluminum supporting block are mutually nested together and two ends thereof are fixed by the spacer.

3. The high magnetic field superconducting magnet system with large crossing warm bore according to claim 1, characterized in that, said high temperature superconducting coil is located inside the low temperature superconducting coil, the low temperature superconducting coil and the high temperature superconducting coil are powered separately.

4. The high magnetic field superconducting magnet system with large crossing warm bore according to claim 1, characterized in that, a heater is mounted in axial direction of inner surface of said high temperature superconducting coil and said low temperature superconducting coil so as to adopt a quench manner of thermal trigger.

5. The high magnetic field superconducting magnet system with large crossing warm bore according to claim 1, characterized in that, said low temperature superconducting coil and said high temperature superconducting coil are supported and fixed together by a drawbar.

6. The high magnetic field superconducting magnet system with large crossing warm bore according to claim 5, characterized in that, said low temperature superconducting coil and said high temperature superconducting coil are connected to the flange of the low temperature container by a supporting drawbar and the thermal shield, thus said low temperature superconducting coil and said high temperature superconducting coil as a whole are supported inside the low temperature container.

7. The high magnetic field superconducting magnet system with large crossing warm bore according to claim 6, characterized in that, a thermal switch is connected to the primary cold head and the secondary cold head of the cryocooler, and the two ends of the low temperature superconducting coil and the high temperature superconducting coil are fixed by a magnet-reinforced supporting flange, wherein the magnet-reinforced supporting flange is connected to the secondary cold head of the cryocooler by the cold conduction strip, thus conducting the cold energy from the cryocooler to the low temperature superconducting coil and the high temperature superconducting coil.

8. The high magnetic field superconducting magnet system with large crossing warm bore according to claim 7, characterized in that, the low temperature superconducting coil and the high temperature supporting coil have current introduced thereto via a room temperature current lead and a high temperature superconducting current lead respectively.

9. The high magnetic field superconducting magnet system with large crossing warm bore according to claim 8, characterized in that, said superconducting magnet system conducts quench protection by a quench protection diode.

* * * * *